US006257902B1

(12) United States Patent
Shieh

(10) Patent No.: US 6,257,902 B1
(45) **Date of Patent: *Jul. 10, 2001**

(54) PORTABLE COMPACT FLASH CARD CONNECTOR WITH A PARALLEL (PRINTER) PORT CONTROL BOARD AND A U-SHAPED FRAME

(76) Inventor: Ron-Yen Shieh, P.O. Box 82-144, Taiwan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/429,708

(22) Filed: Oct. 29, 1999

(51) Int. Cl.[7] ..... H01R 12/00

(52) U.S. Cl. ..... 439/76.1; 439/638; 439/945; 361/685

(58) Field of Search ..... 439/638, 945, 439/637, 64, 377; 361/395, 685

(56) References Cited

U.S. PATENT DOCUMENTS 5,036,429 * 7/1991 Kaneda et al. ..... 361/392
5,184,282 * 2/1993 Kaneda et al. ..... 361/395
5,406,450 * 4/1995 Shieh ..... 361/686
5,519,571 * 5/1996 Shieh ..... 361/685
5,752,857 * 5/1998 Knights ..... 439/638

* cited by examiner

*Primary Examiner*—Paula Bradley
*Assistant Examiner*—Truc Nguyen
(74) *Attorney, Agent, or Firm*—A & J

(57) ABSTRACT

A portable compact flash card connector with a parallel (printer) port control board and a U-shaped frame includes a casing composed of an upper cover and a lower cover engaged with the upper cover, and a control card fixedly fitted within the casing and having a parallel (printer) port interface input connector partly protruding out of the casing, a parallel (printer) port output connector partly protruding out of the casing, and a compact flash card connector having two parallel racks each extending outwardly from each end of the compact flash card connector thereby forming a U-shaped frame for receiving a compact flash card.

2 Claims, 4 Drawing Sheets

PORTABLE COMPACT FLASH CARD CONNECTOR WITH A PARALLEL (PRINTER) PORT CONTROL BOARD AND A U-SHAPED FRAME

CROSS-REFERENCE

This application is related to the U.S. Pat. Nos. 5,406,540 and 5,519,571, owned by the same inventor.

BACKGROUND OF THE INVENTION

1. Field of the Invention

This invention is related to a portable compact flash card connector with a parallel (printer) port control board and a U-shaped frame.

2. Description of the Prior Art

It has been found that the compact flash card is a semiconductor drive of international standards and works like commonly used hard disk drives. As the compact flash card is lightweight, compact in size and easily replaceable, it is generally used in mobile electronic devices such as digital cameras, personal digital assistance, personal organizers, voice recorders, and so on. The compact flash card can work at a relatively low voltage and so it is fit to be used as a storage system for the above-mentioned electronic devices. However, it is unfortunate that the commonly used desktop and notebook computers cannot be connected with the compact flash card.

Therefore, it is an object of the present invention to provide a portable compact flash card connector with a parallel (printer) port control board and a U-shaped frame which can easily connect a compact flash card with a desk or notebook computer.

SUMMARY OF THE INVENTION

This invention is related to a portable compact flash card connector with a parallel (printer) port control board and a U-shaped frame.

It is the primary object of the present invention to provide a portable connector with a parallel (printer) port control board and a U-shaped frame with which a compact flash card can be easily connected.

It is another object of the present invention to provide a portable compact flash card connector with a parallel (printer) port control board and a U-shaped frame which is lightweight and compact in size.

It is still another object of the present invention to provide a portable compact flash card connector with a parallel (printer) port control board and a U-shaped frame which is low in cost.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts.

BRIEF DESCRIPTION OF THE DRAWINGS

The invention is further described hereafter, by way of example only, with reference to the accompanying drawings, in which.

DETAILED DESCRIPTION OF THE PREFERRED EMBODIMENT

Figure 1:
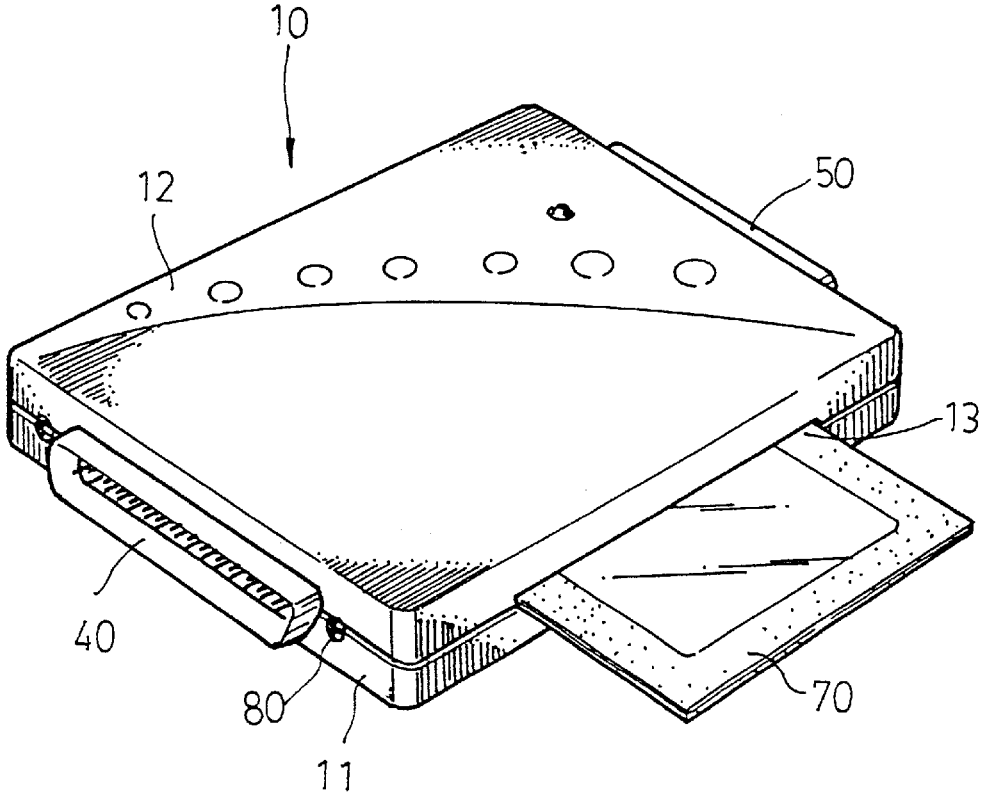
FIG. 1 is a perspective view of the present invention.
Figure 2:
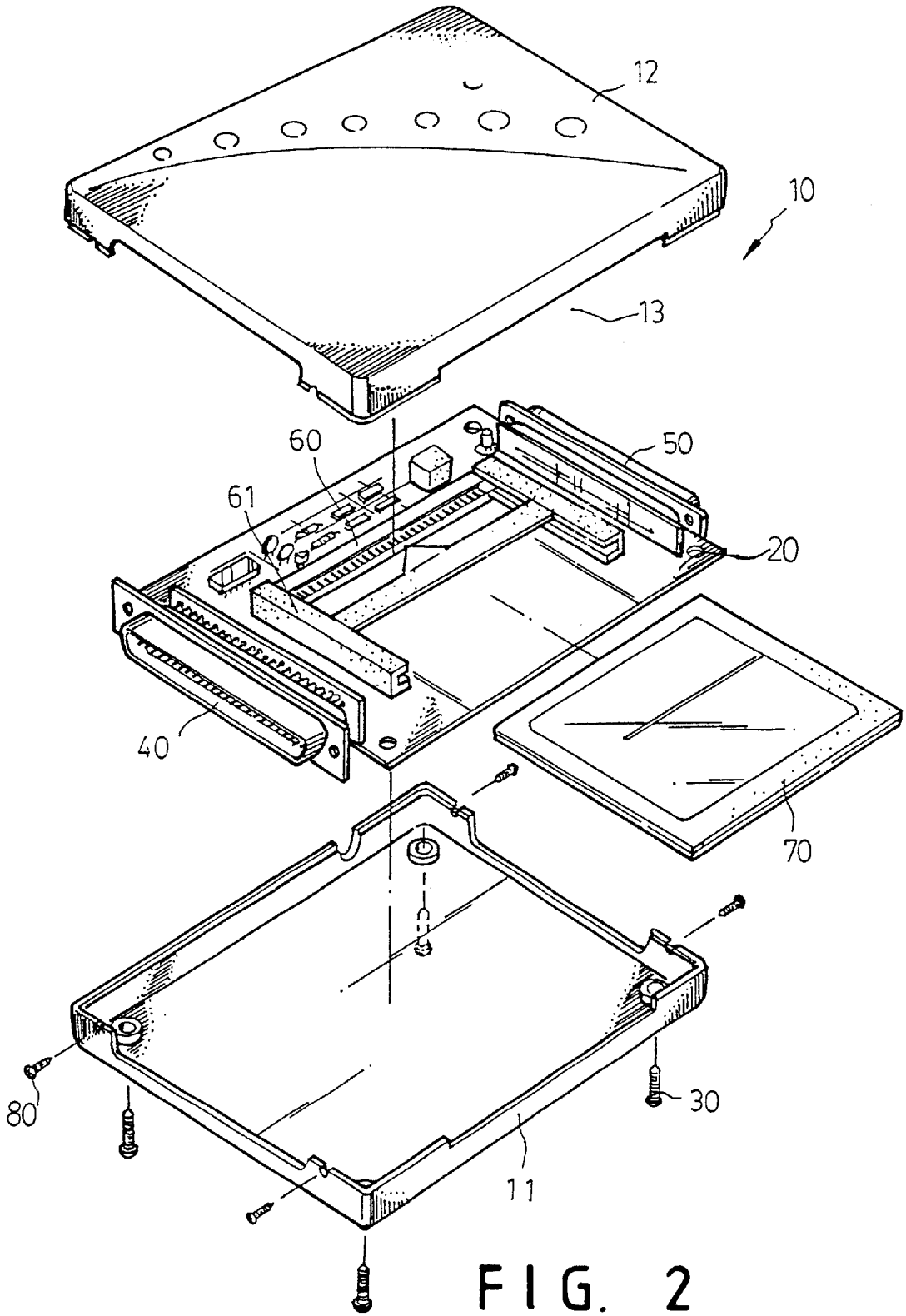
FIG. 2 is an exploded view of the present invention.
Figure 3:
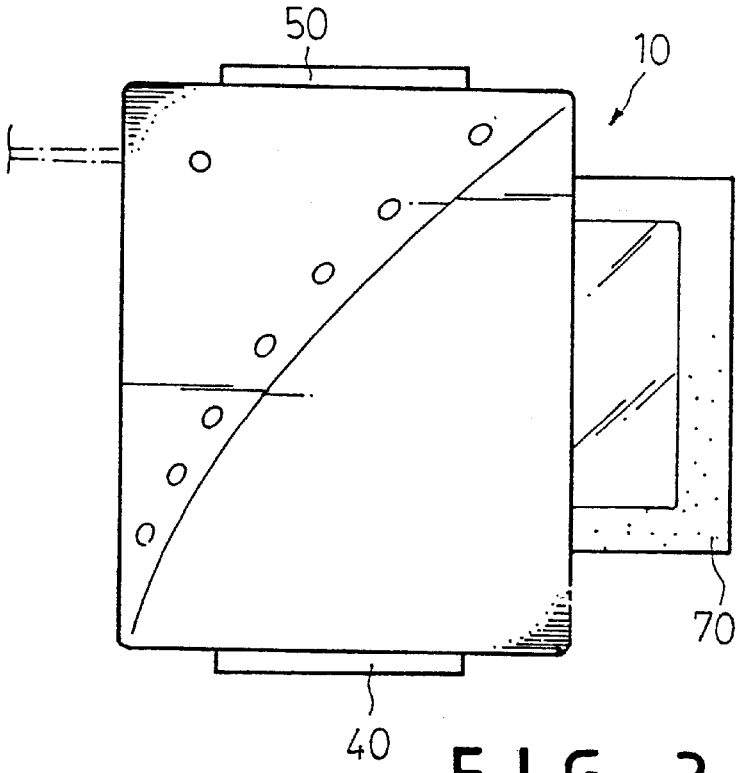
FIG. 3 is a top view of the present invention.
Figure 4:
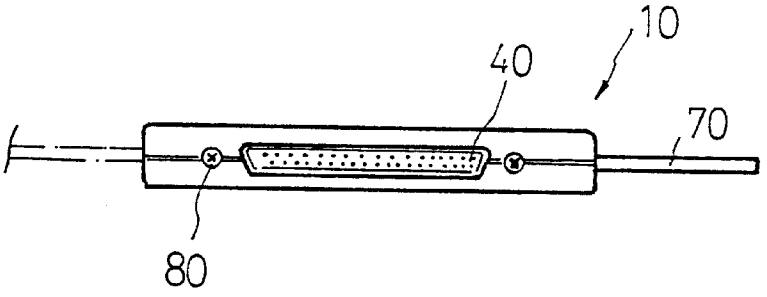
FIG. 4 is a side view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to the drawings and in particular to FIGS. 1, 2, 3 and 4 thereof, the portable compact flash card connector with a parallel (printer) port control board and a U-shaped frame according to the present invention comprises a casing 10 composed of an upper cover 12 and a lower cover 11. The upper cover 12 is engaged with the lower cover 11 by screws 30. Fitted in the cover cover 2 is a control board 20 which is provided with a parallel (printer) port interface input connector 40, a parallel (printer) port output connector 50, and a compact flash card connector 60. The parallel (printer) port interface input connector 40 and the parallel (printer) port output connector 50 extend partly out of the casing 10. The compact flash card connector 60 is provided with two parallel racks 61 extending outwardly at two opposite ends thereby forming a U-shaped frame for facilitating the engagement between a compact flash card 70 and the compact flash card connector 60. The casing 10 is formed with a recess 13 for facilitating the disengagement of the compact flash card 70 from the compact flash card connector 60. The control board 20 is fixedly mounted within the casing 10 by screws 30, with the parallel (printer) port interface input connector 40 and the parallel (printer) port output connector 50 fastened on two ends of the casing 10 by screws 80.

Figure 5:
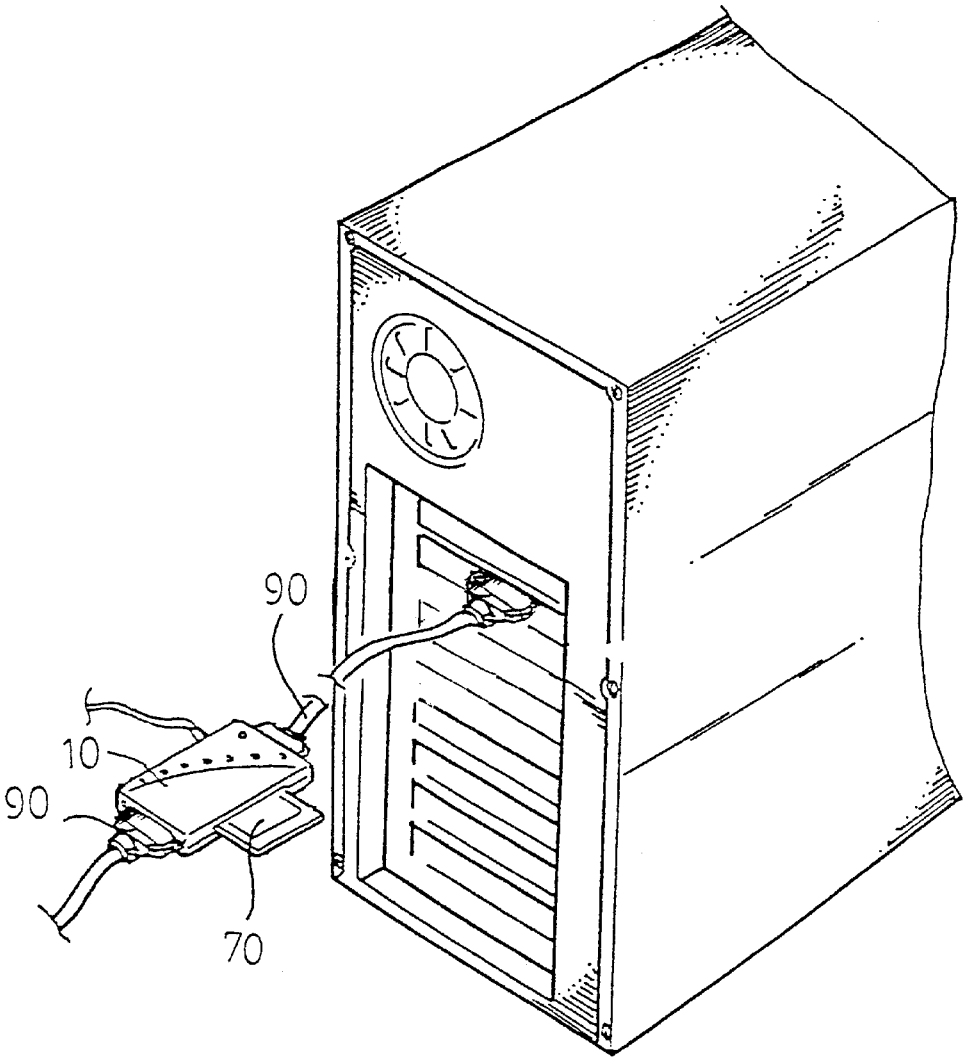
FIG. 5 is a working view of the present invention.

Turning now to FIG. 5, the parallel (printer) port output connector 50 of the present invention is connected with a computer printer port via a first printer cable 90, while the parallel (printer) port interface input connector 40 is connected with a printer (not shown) via a second printer cable 90. Hence, one may use the computer to read or write files from the compact flash card 70 through a printer interface.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A portable compact flash card connector with a parallel (printer) port control board and a U-shaped frame, comprising:

a casing including an upper cover and a lower cover engaged with said upper cover; and a control card fixedly fitted within said casing and having a parallel (printer) port interface input connector partly protruding out of said casing, a parallel (printer) port output connector partly protruding out of said casing, and a compact flash card connector having two parallel racks each extending outwardly from each end of said compact flash card connector thereby forming a U-shaped frame for receiving a compact flash card.

2. The portable compact flash card as claimed in claim 1, wherein said casing is formed with an opening opposite to said U-shaped frame thereby making it easier to engage or disengage a compact flash card with said compact flash card connector.

* * * * *